US005195469A

United States Patent [19]

Syed

[11] Patent Number: 5,195,469

[45] Date of Patent: Mar. 23, 1993

[54] CONTROLLED VARIABLE COMPRESSION RATIO INTERNAL COMBUSTION ENGINE

[76] Inventor: Ahmed Syed, 1101 W. 29th St., Apt. 3, Los Angeles, Calif. 90007

[21] Appl. No.: 744,561

[22] Filed: Aug. 13, 1991

Related U.S. Application Data

[63] Continuation-in-part of Ser. No. 497,666, Mar. 23, 1990, abandoned.

[51] Int. Cl.[5] ..... F02B 75/04

[52] U.S. Cl. ..... 123/48 A; 123/78 R

[58] Field of Search ..... 123/48 R, 48 A, 48 AA, 123/48 D, 78 R, 78 D

[56] References Cited

U.S. PATENT DOCUMENTS

| | | | |
|---|---|---|---|
| 2,163,015 | 6/1939 | Wagner | 123/48 AA |
| 4,539,946 | 9/1985 | Hedelin | 123/48 A |
| 4,860,711 | 8/1984 | Morikawa | 123/48 D |

*Primary Examiner*—Noah P. Kamen
*Attorney, Agent, or Firm*—John E. Halamka

[57] ABSTRACT

An improved arrangement for controlling and adjusting the compression ratio of an internal combustion engine (10) during operation. A secondary cylinder (201) is formed in the engine cylinder head (102) and opens upon the combustion chamber (110) of the engine. A secondary piston (203) is positioned by a control device (503) within the secondary cylinder (201). The rear most position corresponding to the lowest compression ratio. The desired position of the secondary piston (203), that compression ratio which corresponds to maximum efficiency of the engine, is controlled by a logic unit (816) operating upon such inputs as the engine load as correlated to the input manifold pressure, the engine RPM and the present position of the secondary piston (203). The linkage of the control may utilize a servo motor or hydraulic driver to rotate a shaft (301). All secondary pistons (203) may be operated in unison or a control system may be provided for each cylinder (201). An involute surface (302) mounted on the shaft (301) pushes the spring (204) loaded secondary piston (203) into the secondary cylinder (201). A worm gear (602) on the shaft (301) may turn a threaded bolt (603) to position the secondary piston (203). Or, a worm gear (813) may engage a gear (814) formed on the involute (815) to directly position the involute surface (815).

22 Claims, 8 Drawing Sheets

Fig. 6.
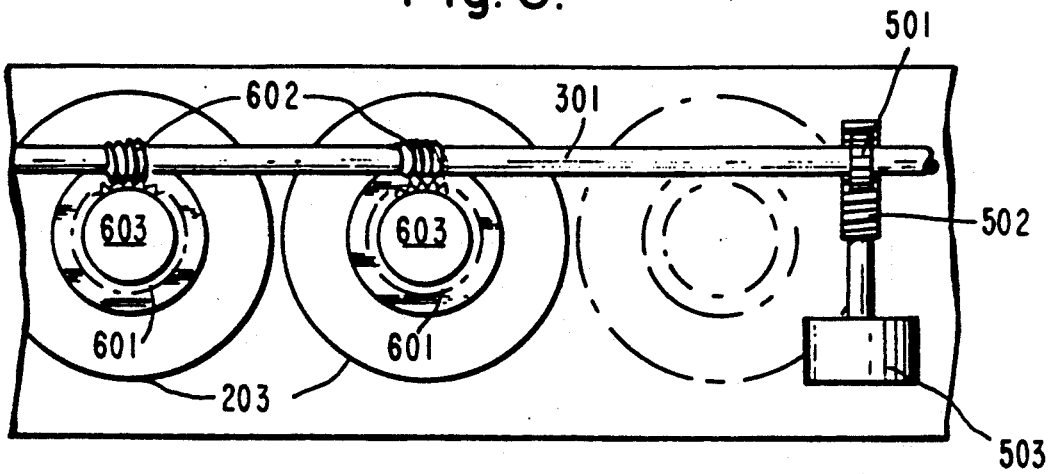
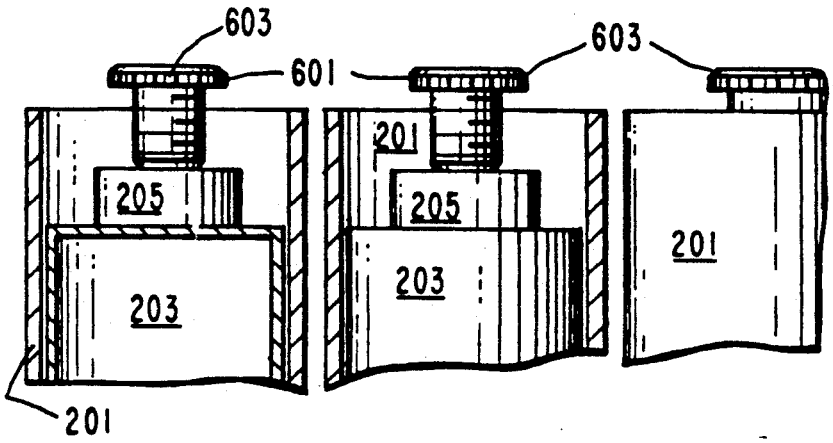
Fig. 7.
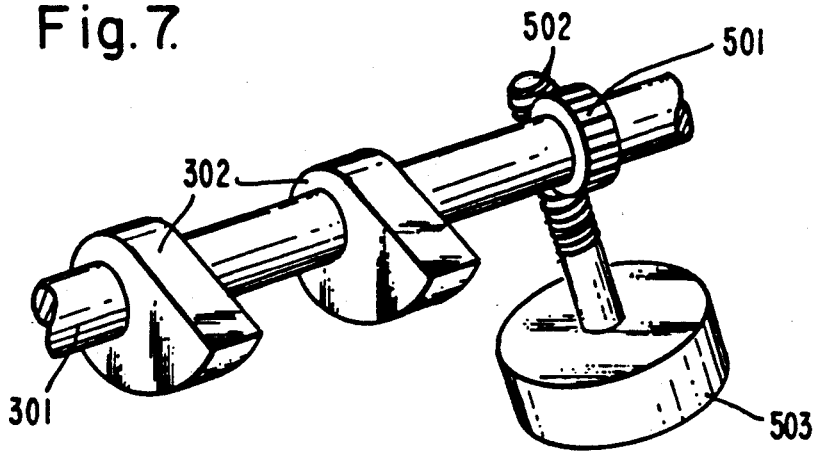
Fig. 3.

CONTROLLED VARIABLE COMPRESSION RATIO INTERNAL COMBUSTION ENGINE

This application is a continuation in part of a prior application filed Mar. 23, 1990 as Ser. No. 07/497,666, now abandoned by applicant Ahmed Syed, and which is abandoned upon completion and acceptance of the filing of this CIP application.

BACKGROUND OF THE INVENTION

1. Field of the Invention

This invention relates to the internal combustion engine art and, more particularly, to an improved arrangement for controlling the compression ratio of the engine.

2. Description of the Prior Art

The theory of internal combustion engines states that thermal efficiency, which is directly related to fuel economy, is directly proportional to compression ratio.

Compression ratio (CR) is defined as the ratio of the total internal volume between the top surface of the piston and the bottom surface of the cylinder head of a cylinder when the piston is at bottom dead center (BDC) to the clearance volume of the cylinder when the piston is at top dead center (TDC). The space between the piston and the cylinder head at TDC is also known as the combustion chamber.

$$CR = \text{Total vol at } BDC / \text{Clearance vol at } TDC$$

There is always a clearance space enclosed by the piston top surface and the inner surface of the cylinder head when the piston is at TDC.

It is important to differentiate between compression ratio and compression pressure (CP), although they are directly related. Typical compression ratios of modern spark ignition engines are anywhere from 8 to 9.5. The compression ratio for a particular spark ignition internal combustion engine design is selected after a determination of what safe compression pressures the engine can handle without the fuel mixture detonating prematurely.

The CP at part throttle will be lower than at full throttle. Thus, CR is limited by the maximum (full throttle) CP. This limitation, a) hinders the use of very lean mixtures for emission control, and, b) places an undesirable limitation on the theoretical efficiency of the engine.

But an automobile is driven mostly at part throttle. During partial throttle operation, the CR may be safely increased without exceeding maximum safe CP. An an increase in engine efficiency and a decrease in emissions may be realized if the CR is varied in a manner so that CP remains constant near a preselected value. To keep the CP level, the engine compression system must adapt to changing operation and external conditions such as load, speed, etc. and change the compression ratio therein.

A solution to providing variable CR is to somehow control the clearance volume at TDC.

Several variable compression ratio systems have attempted to provide a quiet, stable, controllable arrangement for changing the compression ratio in internal combustion engines. U.S. Pat. No. 4,516,537 teaches the use of a variable position sub-piston under hydraulic control. The '537 patent describes the inherent problem of a number of prior solution of the back-flow of the hydraulic fluid under the intense back pressure of the internal explosion of fuel and air. The prior art systems did not work as expected because the regulation of the compression ratio is accompanied by too large of an error imposed by the intense explosion pressure.

The '537 patent attempts to solve the problems by only moving the sub-piston during the intake and exhaust strokes of the engine. The opening and closing of a check valve is used to activate the movement of the sub-piston. However, '537 discloses that the sub-piston will be forced to a slightly rearward position during the intense power explosion. Such intermittent movement results in noise, vibration and control instability.

A disclosure in the Japanese patent No. 88926/81 attempts to solve some of the problems by introducing a hydraulic cylinder with a plunger mounted to be coaxial with the piston rod of the sub-piston used to vary the compression ratio. However, the system results in a stepwise control of the compression ratio which introduces a large error resulting in knock and erratic performance.

Other attempts such as U.S. Pat. No. 2,163,015, and similar U.S. Pat. Nos. 2,040,652 and 2,970,581, have attempted to replace the hydraulic control with a mechanical cam (which in this case was still under hydraulic control). However, the cam does not solve the problem of providing a "solid" configuration under ignition pressure. The geometric design of a cam introduces a lever and fulcrum into the physics of the system. The axis upon which the cam is mounted is never in line with the force vector. Thus there is always a moment force around the axis contributing to movement, noise, error and inoperability.

Thus, there has long been a need for an improved arrangement for controlling the compression ratio of the engine which provides positioning of a means to vary the clearance volume of the cylinder at TDC.

It is also desired that the control means be continuously variable and vibration resistant to provide noise free and error free efficient operation of the engine.

SUMMARY OF THE INVENTION

Accordingly, it is a object of the present invention to provide an arrangement for changing the TDC clearance volume of a cylinder in a vehicle while the engine is operating.

It is another object of the present invention to provide an improved control arrangement which is continuous over the range of operation.

It is yet another object of the present invention to provide a method of control which diminishes or eliminates any vibration in the control mechanism due to off axis moment forces during ignition stroke of the engine.

It is yet another object of the present invention to provide a "solid" control mechanism which does not introduce variations in the TDC clearance volume as the result of recoil of the control mechanism from the intense explosive force of ignition.

It is another object of the present invention to present a design based on ease of manufacturability with a minimum modification to the cylinder head design.

It is a further object of the present invention to provide a highly reliable means for achieving the objective with a minimum of moving parts and the elimination of hydraulics with its associated components.

It is yet another object of the present invention to develop an arrangement which may use extremely lean mixtures thus reducing undesirable emissions without resorting to less efficient methods such as stratified charge or high energy ignition devices.

The above and other objects of the present invention are achieved, according to a preferred embodiment thereof, by providing a control mechanism incorporating the geometry of an involute so that the moment of force generated by the shaft of the control piston is reduced to a very low value.

The variable TDC clearance is generated by a movable secondary piston mounted within a secondary cylinder which opens upon the clearance space between the primary piston and the primary cylinder at TDC. The secondary piston is mounted with a spring. The return spring positions the secondary piston at a location most remote from the primary piston and firmly pressed against the surface of the involute.

The position of the secondary piston is controlled by the rotational position of an involute mounted on a shaft and positioned to be in contact with the secondary piston cap extended above the secondary piston. The force vector of the secondary piston will be directed to the center of the shaft and involute arrangement reducing the moment around the shaft to almost zero. For this purpose the end surface of the secondary piston cap may be formed in a wedge shape to conform to the shape of the surface of the involute. This insures that the upward force on the secondary piston will be in line with and directed toward the center of the shaft and involute arrangement thereby reducing the moment of reverse torque about the shaft to a very low value.

Because of the near zero reverse torque applied to the involute and shaft, the noise, vibration, and error of control of the position of the secondary piston becomes negligible.

The involute may be the archimedian or the logarithmic involute shape. The main objective is to provide a control surface that is uniformly increasing/decreasing in diameter.

The control of the rotation of the shaft and involute arrangement with the subsequent positioning of the secondary piston to achieve a desired compression ratio is well known in the art. In the preferred embodiment, the control device utilizes an electric motor acting on the shaft through a worm and gear arrangement. The worm and gear arrangement achieves a further reduction ratio in stability and further diminishes the reaction of the system to reverse torque.

In yet another embodiment, the involute is supported by a shaft but driven by a sleeve surrounding the shaft. The sleeve communicates with the involute by means of a spring to advance the involute only during periods of low back pressure. The involute communicates with the shaft by means of a ratchet whereby the involute will advance in only one direction and only during low pressure. The ratchet prevents movement in the other direction. The involute is repositioned by means of moving the shaft.

Any such control device responding to the preselected variables of air temperature, pressure, octane rating of the fuel, engine temperature, etc. may be incorporated in the algorithm used by the control device to determine the rotational position and achieve the preselected engine efficiency by changing the compression ratio.

BRIEF DESCRIPTION OF THE DRAWING

The above and other embodiments of the present invention may be more fully understood from the following detailed description, taken together with the accompanying drawing, wherein similar reference characters refer to similar elements throughout, and in which:

FIG. 3 is a perspective view of the involute/shaft arrangement with control device;

FIG. 6 illustrates another embodiment of the present invention;

FIG. 7 illustrates a cross sectional view of the another embodiment of the present invention;

DESCRIPTION OF A PREFERRED EMBODIMENT

The purpose of this invention is to provide an arrangement which may be used to increase internal combustion engine thermal efficiency. The efficiency is a function of the compression ratio and the fuel-air ratio.

Unleaded gas and smog control devices have been introduced to reduce undesirable emissions. Higher octane gas is used to prevent knocking. The compression ratio of most engines is fixed at a range of 8 to 9.

The quantities of fuel and air may be controlled to try to provide an ideal lean mixture which runs hotter. However, with low compression ratios, the lean mixture burns slower resulting in serious loss of power and sometimes may even fail to ignite. If it is too slow, the burning is incomplete and creates pollutants. The engine controls may increase the fuel to create a richer mixture which burns faster. However, the rich mixture burns cooler and still creates pollutants.

The desired control is to increase compression pressure to the maximum for the current load. With increased pressure, the mixture burns faster. Thus, the ideal mix may be used and pollutants reduced.

Two distinct advantages are achieved at the same time, pollutants are reduced and economy of operation is improved. The theoretical efficiency is enhanced by reducing the combustion chamber volume with a corresponding rise in compression ratio. This also results in a fully compressed charge at all times. Enabling Leaner mixtures to burn faster and more completely. This invention teaches an arrangement to control an increase in the pressure of an internal combustion engine while the engine is operating.

The objective is to maintain a constant pressure of the charge in the combustion chamber prior to ignition regardless of engine load, speed or environmental conditions.

The compression is varied by means of a secondary piston. Under part throttle conditions, the secondary piston moves down to increase the compression ratio.

Under cruising conditions or part throttle conditions, the engine compression ratio is raised to run in a more fuel efficient manner. Since the charge density is made constant at all throttle conditions, it become possible to use extremely lean mixtures reducing pollutants and improving economy. Under heavy load conditions or full throttle acceleration, the engine compression ratio is lowered.

Another significant result of use of the arrangement of this invention is that the high charge density attainable maintains a high flame propagation speed. The ignition timing can then be significantly retarded. This in turn reduces the "negative" work of the rising piston acting against the expanding gases which further improves the fuel economy.

Figure 10:
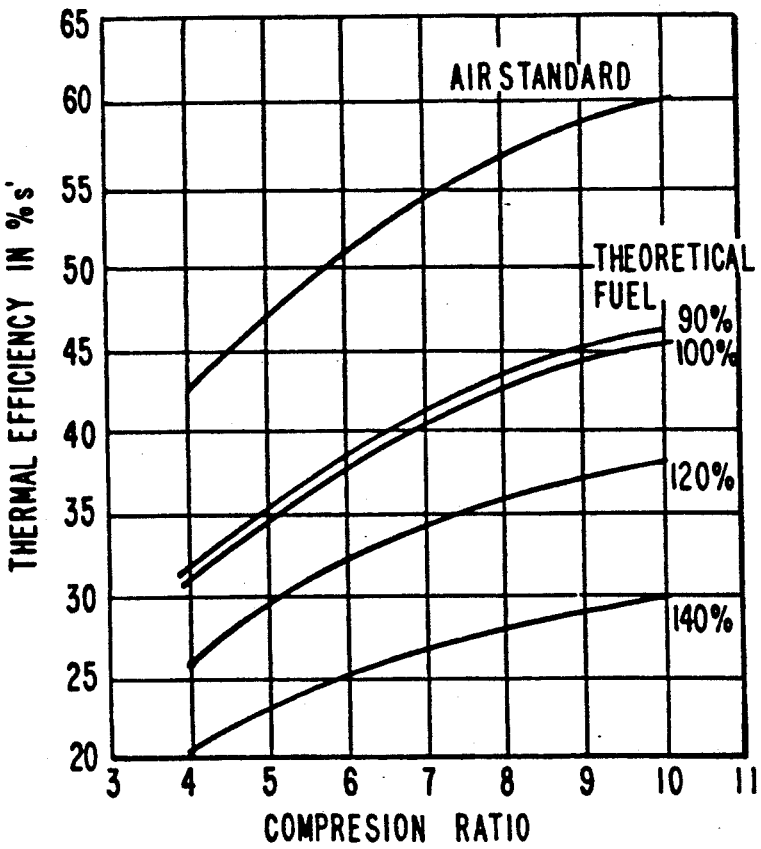
FIG. 10 illustrates the ideal curve.

FIG. 10 is a graph showing the effect of compression ratio on the efficiency of a constant-volume engine. The fuel-air-cycle efficiency is seen to increase with compression ratio. The ratio of fuel-air-cycle efficiency to air-cycle efficiency is roughly constant for a given fuel-air ratio. Efficiency is increased as the compression ratio is increased. The objective of this invention is to squeeze the maximum mileage from a given amount of fuel by running the engine at the highest possible compression ratio.

The elegance of the design of the arrangement of the present invention produces a method of attaining stepless variable compression ratio which is virtually maintenance free, stable, noise free, easy to implement and cost effective.

Figure 1:
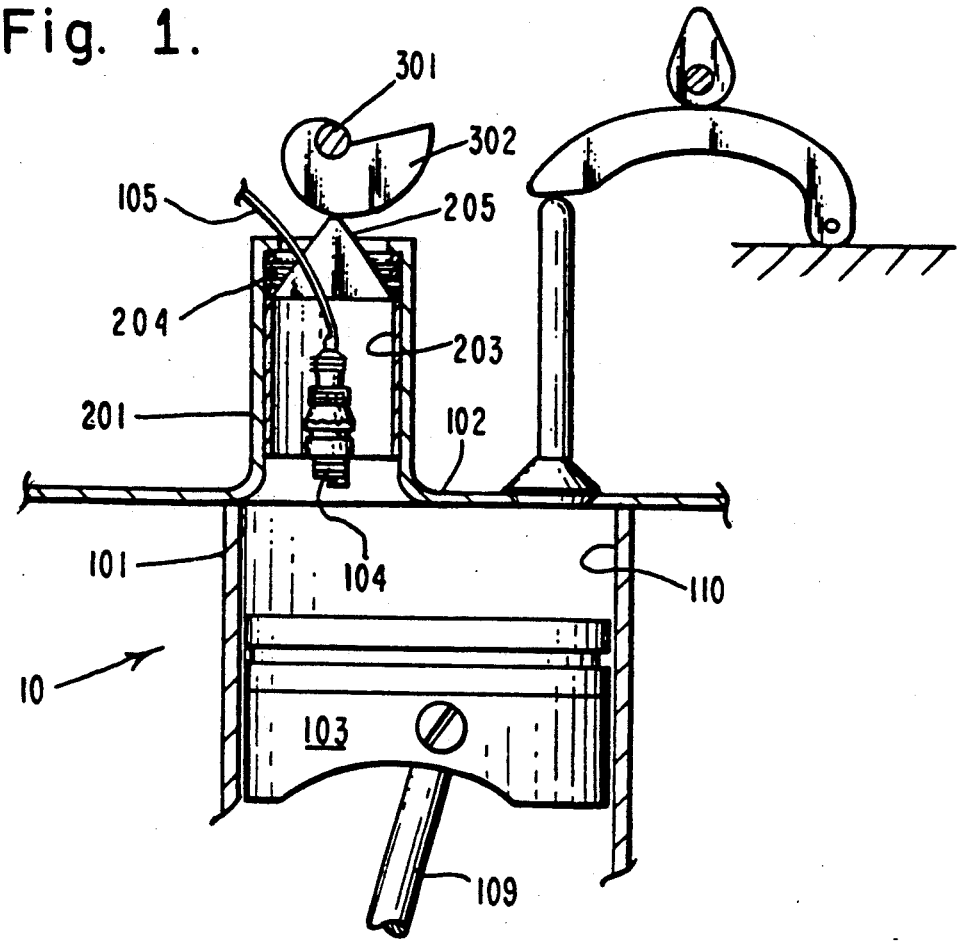
FIG. 1 is a cross sectional view of an engine which shows a secondary cylinder positioned by an involute shaft according to the principles of the present invention.

Referring now to the drawing, there is illustrated in FIG. 1 a cross sectional view of an internal combustion engine generally designated 10. The engine has a primary cylinder 101, a cylinder head 102, and a primary piston 103. Other items necessary for the function of the engine such as intake, exhaust valves, rocker arms, rocker arm camshaft, piston rings, crank shaft, connecting rod, etc. are illustrated but not integral to this invention.

A secondary cylinder 201 is formed in the cylinder head 102 and positioned so that the opening of the secondary cylinder 201 corresponds with a selected part of the volume which comprises the clearance volume at TDC. As illustrated, the opening of the secondary cylinder 201 is fully enclosed within the upper portion of the cylinder head 102 which is opposite the upper surface of the primary piston 103. A secondary piston 203 is mounted within the secondary cylinder 201. The space within the secondary cylinder 201 and below the secondary piston 203 is added to the clearance volume of the engine 10 in computing the compression ratio. As the secondary piston 203 is lowered along the secondary cylinder 201, the clearance volume is reduced and the compression ratio is increased.

Cooling of the secondary cylinder 201 and piston 203 may be provided by means of an oil flow which is well known in the art.

A return spring 204 is attached to the secondary piston 203 to return the secondary piston 203 to the upper most position of the secondary cylinder 201 and keep it firmly pressed to the surface of the involute. The shaft of the actuator (electric motor) incorporates a spring return mechanism to rotate the shaft in the direction of minimum CR in case of loss of power or control signals to the actuator. The minimum CR position is the configuration utilized upon starting and stopping the engine.

The secondary piston 203 must incorporate compression rings, lubrication channels, etc. to function but such items are well known in the art, are not part of the invention herein and therefore, not shown in detail.

Figure 2:
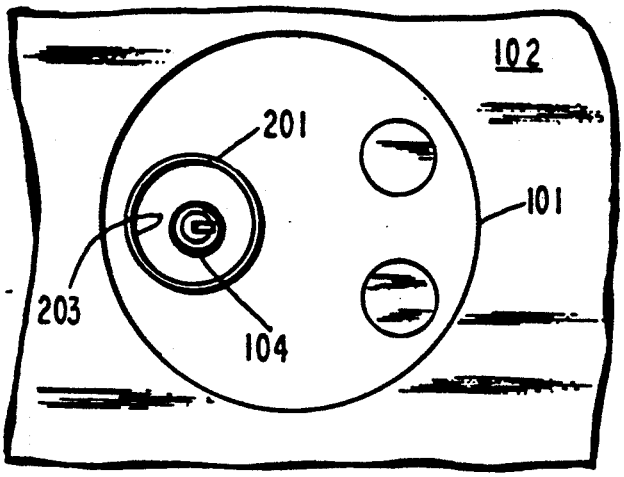
FIG. 2 illustrates the placement of the secondary piston.

In the embodiment shown in FIG. 1, the spark plug 104 is illustrated as mounted within the secondary piston 203 with the spark gap between the electrodes extending into the combustion chamber 110 of the primary cylinder 101, cylinder head 102 and primary piston 103. This configuration allows the secondary piston 203 to be as large as possible. This arrangement is more clearly shown by the diagram of FIG. 2.

The spark plug may be mounted else where given a different arrangement of the secondary cylinder 201 and the intake and exhaust valves incorporated in the design. Multiple intake and exhaust valves may be used to increase the efficiency of the engine. But these items are well known in the art.

Figure 4:
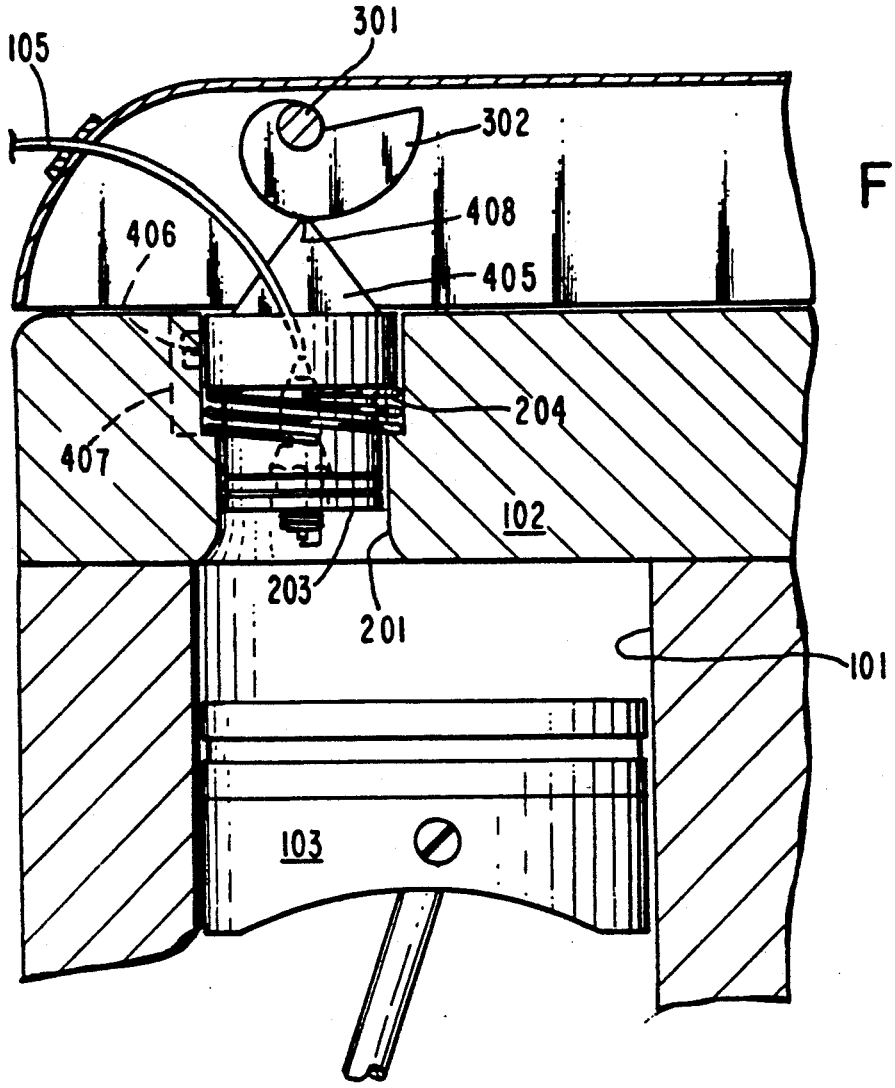
FIG. 4 is a cross sectional view of an engine which illustrates the cap of the secondary cylinder as a wedge.

FIG. 4 shows the spark plug wire 105 from the distributor being connected to the spark plug 104 by means of a connector fitted on the camshaft cover. This could also be performed by providing a service access, hinged door on the camshaft cover. The size, placement and sealing requirements of the door to provide easy access to the spark plugs mounted inside the secondary piston is well known in the art. Alternatively, the camshaft cover could be fitted with cable connectors for passage of cables to the outside of the cover.

The shaft 301 shown in perspective in FIG. 3 may be mounted in bearings on towers and positioned so that the surface of a plurality of involutes 302 are in contact with a plurality of caps 205 for multicylinder engines. The shaft 301 is similar to a camshaft which is well known in the art.

A control device is connected to one end of the shaft 301 and rotates the shaft 301 to a preselected position. As shown in FIG. 4, under the condition of the shaft 301 being rotated counterclockwise, the outside surface of the involute 302 will push down upon the cap 205 which lowers the secondary piston 203 thereby decreasing the clearance volume and increasing the compression ratio of the engine 10 to a preselected value for the present operating conditions.

Fuel and air is input into the cylinder through the intake valve and ignited by the spark plug 104. The resulting explosion places an upward force upon the secondary piston 203 and the primary piston 103. The primary piston 103 will move down and transmit the force through the connecting rod 109 to the crankshaft of the engine 10. The secondary piston 203 will transmit its force through the cap 205 and the involute 302 to the shaft 301. However, because the contact point between the involute 302 and the cap 205 is in-line with the axis of the shaft 301, there is very little, if any, torque applied to the shaft 301 to cause the shaft to change position. It is this stability which sets the arrangement of this invention apart from the prior art. The prior art is very vulnerable to the back pressure changing the control setting. The changes cause the system to vibrate between the desired position and the back pressure position resulting in noise, inefficiency, and wear on the arrangement.

What little torque, which may be experienced during periods of high stress, may be further isolated from the control device through the worm gear 502 and drive gear 501 arrangement between the shaft and the servo control device 503 shown in FIG. 3. The servo control device 503 is illustrated to be an electric motor but may be a hydraulic drive device.

The shaft 301 is rigidly mounted on bearings in towers to the cylinder head. Thus the upward force generated on the secondary piston 203 and transmitted through the cap 205 and the involute 302 to the shaft 301 is controlled.

Figure 5:
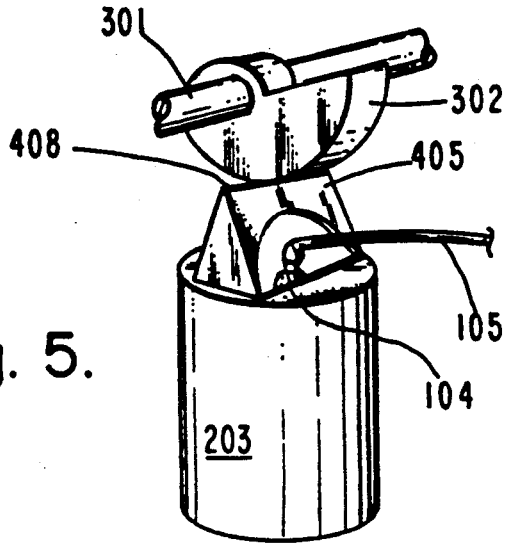
FIG. 5 is a perspective view of the shaped cap wedge arrangement.

FIG. 4 is another embodiment of the present invention showing a shaped cap 405 mounted above the secondary piston 203. The secondary piston 203 is kept in rotational alignment within the secondary cylinder 201 by means of a guide 407 and key 406. This keeps the wedge shaped end 408 of the shaped cap 405 of the secondary piston 203 in normal alignment with the surface of the involute. FIG. 5 shows the detail of the wedge 408 and the alignment of the cap 408 on the surface of the involute 302. By use of this alignment, the force vector of the shaped cap 405 acts through the center of the shaft 302 with a resultant zero torque force acting on the shaft 302.

The control of the position of the shaft may utilize an electric servo motor. As the mechanical positioning apparatus reduces the torque of the back pressure to zero, a hydraulic position control actuator may be used.

The control means may utilize automatic braking to eliminate overshoot and backlash. The position of the control means may have a simple correspondence to the intake manifold vacuum.

The intake manifold butterfly may incorporate a dash pot to damp the throttle response to allow the control system to follow the motion of the intake manifold butterfly valve.

Figure 9:
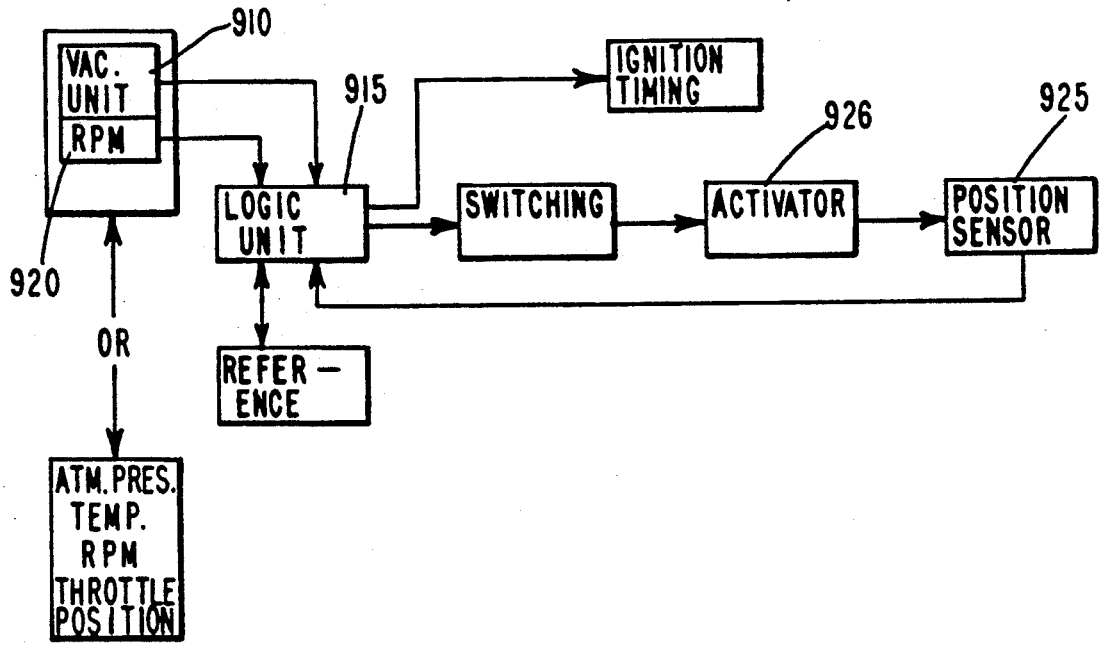
FIG. 9 illustrates a block diagram of the position control.

FIG. 9 illustrates a block diagram of a control method. Because it is impractical to measure the pressure in a cylinder while it is in operation, an indirect method to compute the relative amount of charge present in a cylinder is used. A fairly accurate indication is the inlet manifold vacuum. A vacuum manifold sensor produces a signal for input to the logic unit.

When the vehicle is accelerating or climbing a grade or moving at a very high rate of speed, the manifold vacuum will be relatively low. Intake manifold vacuum is a direct parameter for establishing engine load and a fairly accurate means for determining the amount of charge entering the cylinders.

Alternatively, the logic unit could combine inputs from several variables such as atmospheric pressure, engine RPM, throttle position, engine temperature, etc. to evaluate current compression ratio.

FIG. 9 illustrates that RPM sensor 920 is another input which may be utilized by the logic unit.

The position sensor 925 of the actuator 926 indicates to the logic unit 915 the present position of the involute 302 and thus the compression ratio of the engine.

The reference 927 contains a table established for the engine and vehicle type to allow the logic unit 915 to compare current engine charge, RPM and compression ratio to the desired compression ratio established to produce top efficiency. The logic unit will then calculate a clockwise or counterclockwise position control signal and communicate that signal to the actuator 926. The position sensor 925 provides the feed back to allow the logic unit 915 to determine when the actuator has turned the involute 302 to the position to achieve the desired compression ratio. Upon arrival at the desired position, the logic unit 915 will disengage the actuator 926. A switch may be provided to lock the actuator in its present position to further stiffen the tolerance of the system to backpressure.

The objective is to maintain the compression ratio at the highest possible level for the conditions. The only limiting factor is that preignition pressure not exceed a maximum tolerable value.

This process of achieving the optimum compression ratio for the present operation of the engine is essentially continuous. The position of the involute 302 may stay essentially the same for a period of time depending upon the driving conditions.

As the actuator 926 will require a finite time to position the involute 302, a damping mechanism may be utilized on the main throttle butterfly valve to ensure that it cannot be opened or closed too quickly. The damping action should closely follow the response time of the actuator 926 to allow the system time to "catch up."

Alternately, an additional throttle plate under the control of the logic unit may be utilized. Such control systems are well known in the art.

FIG. 6 and 7 show another embodiment of threaded bolts 603 driven by a worm gear 502 moving a drive gear 501 on the shaft 301. The bolt 603 replaces the action of the involute 302. A second worm gear 602 mounted on the shaft 301 engages a second drive gear 601 formed in the top portion of the threaded bolt 603. As the bolt 603 is rotated by the second drive gear 601, it pushes down on the cap 205 mounted on the secondary cylinder 203. The back pressure of the secondary cylinder 203 against the bolt 603 will create some torque force on the bolt 603 and tend to unscrew it. However, the torque on the second drive gear 601 against the second worm gear 602 transmitted as torque on the drive gear 501 to the worm gear 502 is significantly reduced by a preselected gearing ratio so that any rearward movement of the bolt 603 is controlled.

The gear head portion of the bolt 603 may be attached to the threaded portion of the bolt 603 by means of a key inserted into a guide. This may increase the strength of the arrangement over a one piece molded or machined part.

Figure 8:
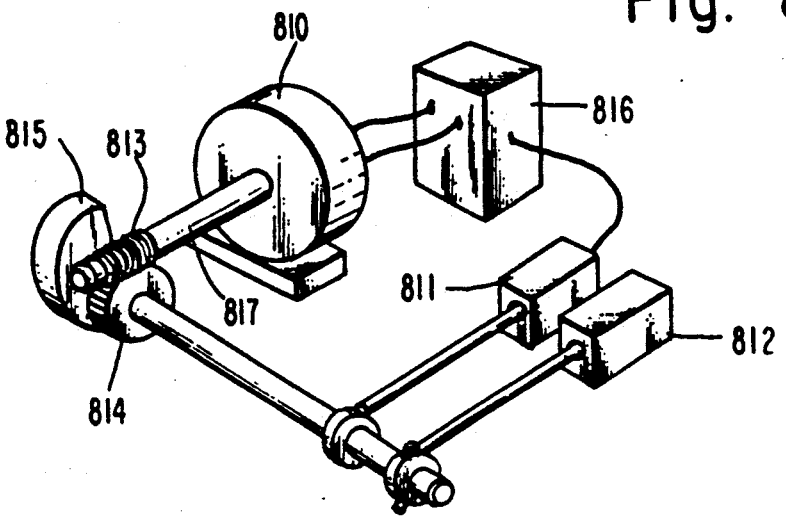
FIG. 8 illustrates another embodiment of the present invention.

FIG. 8 illustrates yet another embodiment of the present invention in which the position of each involute 815 is independently controlled by a separate logic unit 816 or one channel of a multichanneled control unit.

The control unit 816 is connected to the servo motor actuator 810 and directs it to rotate in the desired direction. A worm gear 813 is mounted on the shaft 817 of the servo motor actuator 810 and engaged with gear 814. Gear 814 is formed as part of the involute 815 and rotatably mounted to the cylinder head of the motor to be controlled. The servo motor position sensor 811 provides input to the logic unit 816. The control signal from the logic unit 816 to the servo motor actuator is terminated when the position sensed by the servo motor position sensor 811 indicates that the involute 815 has moved the secondary piston 203 to the preselected position. The servo limit switch 812 protects the control system from rotating beyond preselected limits by disengaging the servo motor actuator 810. The limit switch 812 may be incorporated into a fail safe position circuit to allow the servo motor actuator 810 to move the involute 815 to the minimum compression ratio position upon loss of the logic unit 816 or selected inputs to the logic unit 816.

Figure 11:
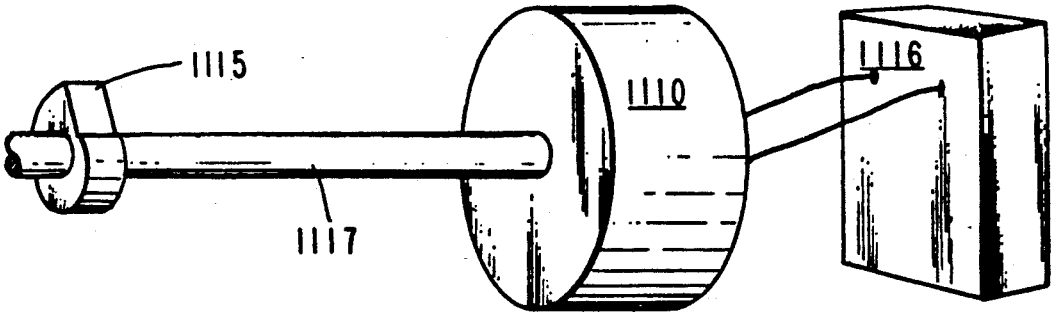
FIG. 11 illustrates another embodiment of the present invention.

FIG. 11 illustrates yet another embodiment of the present invention in which the position of each involute 1115 is independently controlled by a separate logic unit 1116 or one channel of a multichanneled control unit. The involute 1115 which controls the position of a cap 205 as described above is mounted on the shaft 1117 of the servo motor actuator 1110 in the same manner as described above.

Figure 12:
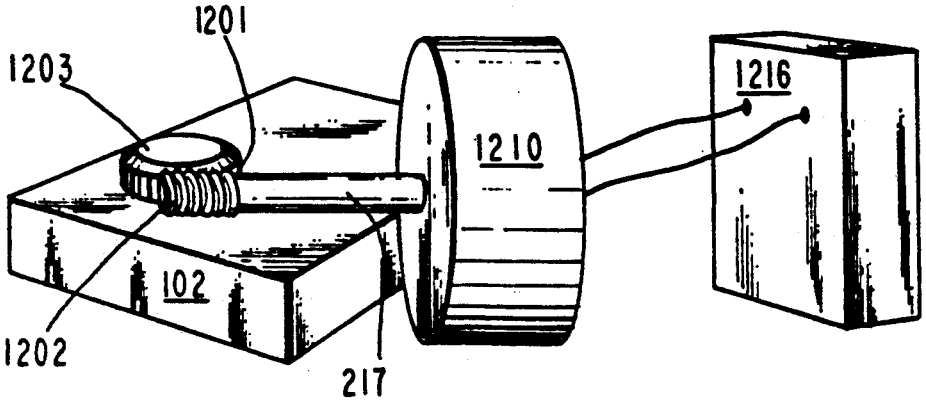
FIG. 12 illustrates yet another embodiment of the present invention.

FIG. 12 illustrates yet another embodiment of the present invention in which the position of each threaded bolt 1206 is independently controlled by a separate logic unit 1216 or one channel of a multichanneled control unit. The rotated position of the threaded bolt 1206 which controls the position of the cap 205, as described above, corresponds to the rotation of the worm gear 1202 mounted on shaft 1217 of the servo motor actuator 1210 in the same manner as described above.

FIGS. 13 through 17 illustrate yet another embodiment of the present invention in which the positioning of the involute is achieved with minimum power because the involute is advanced only during times of low pressure in the combustion chamber.

Figure 13:
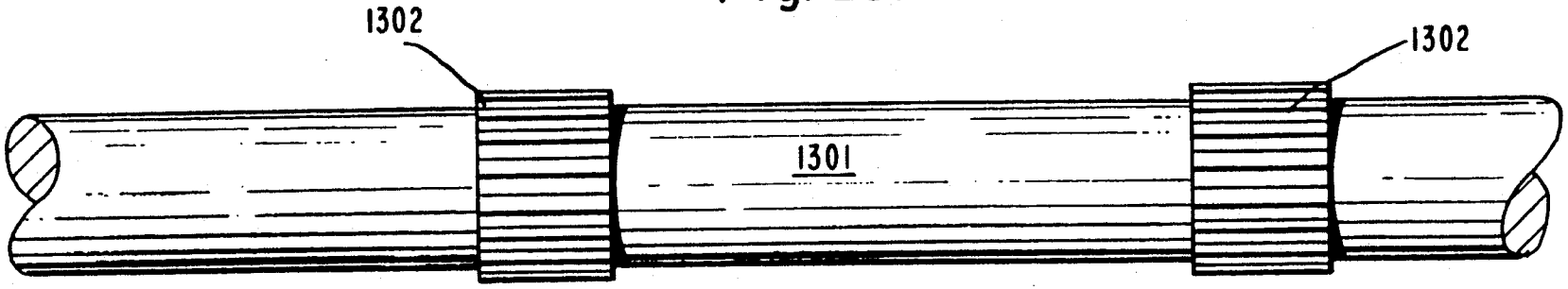
FIG. 13 illustrates a base shaft with ratchet of yet another embodiment of the present invention.

FIG. 13 depicts a base shaft 1301 on which is formed a ratchet 1302.

Figure 15:
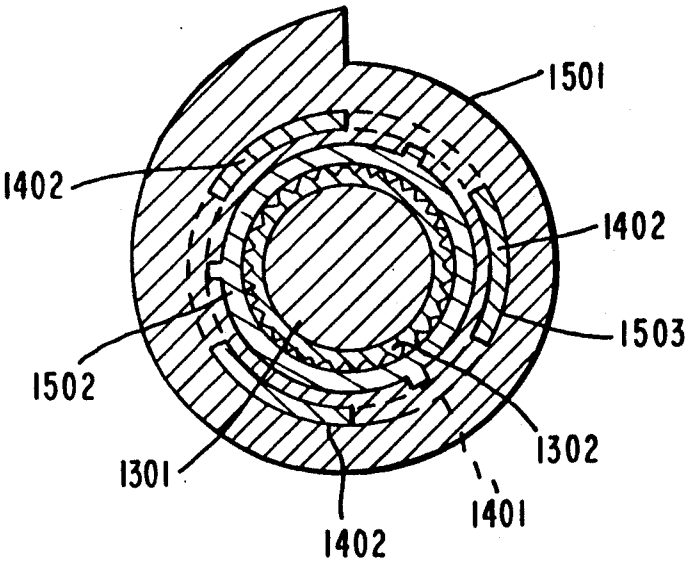
FIG. 15 illustrates a involute used with the base shaft and sleeve embodiment of the present invention.
Figure 14A:
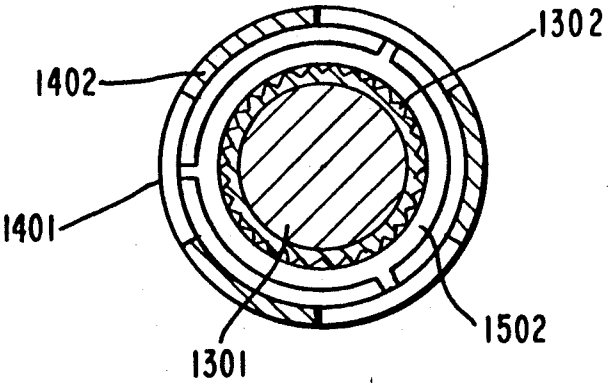
FIG. 14A is a cross section of a partially assembled mounting for an involute.

FIG. 15 depicts an involute 1501 in which a plurality of notches 1503 are formed at a preselected radius. A first wall 1504 is formed in the center of the involute and a click/lock mechanism 1502 is mounted in the inside surface of the first wall 1504. One involute 1501 with click/lock mechanism 1502 is mounted onto the base shaft 1301 over each ratchet 1302.

Figure 14:
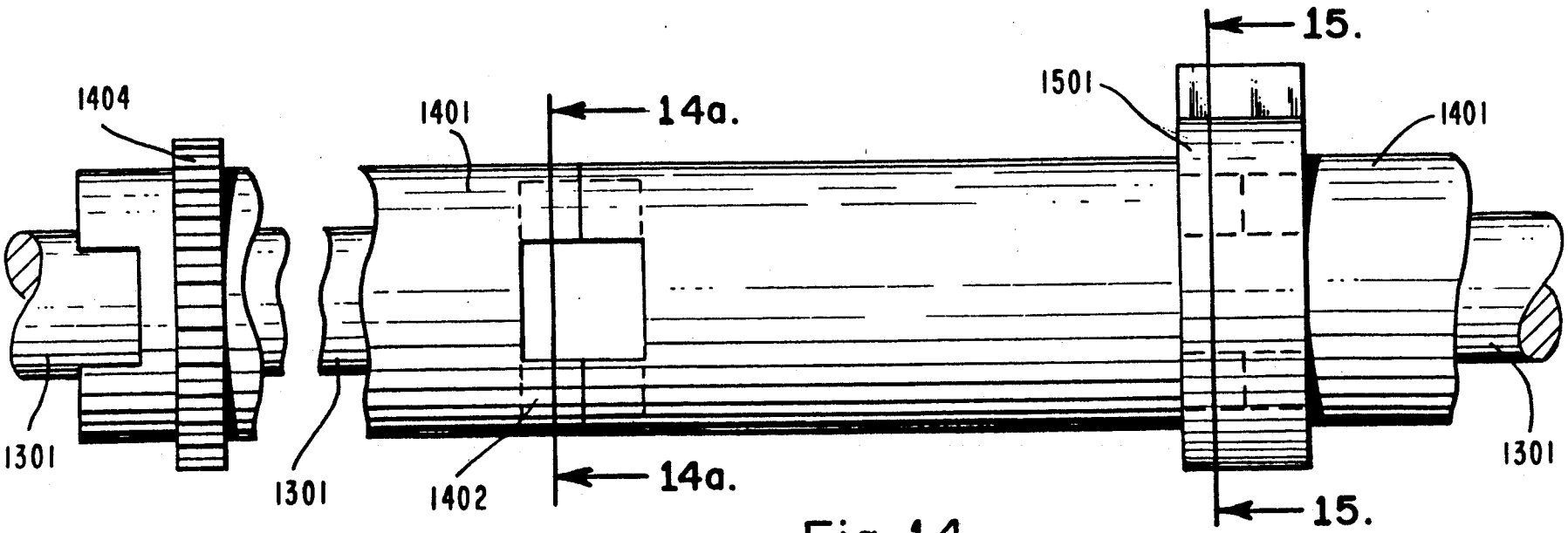
FIG. 14 illustrates a sleeve for the base shaft shown in FIG. 13.

Now referring to FIG. 14, a sleeve 1401 of a preselected inside diameter to fit over the base shaft 1301. The sleeve 1401 is formed with fingers 1402 which can be mounted through the notches 1503 of the involute 1501. A spring 1403 is mounted on the sleeve 1401 to communicate torque from the sleeve 1401 to the involute 1501 upon the rotational movement of the sleeve 1401. The position of the sleeve 1401 is controlled by a servo motor actuator or hydraulic actuator as described above for other embodiments. A gear 1404 is formed on a selected portion of the sleeve 1401 to allow rotational information to be communicated between the actuator and the sleeve 1401 by such means as a worm gear or directly coupled gear transmission.

Upon movement of the sleeve 1401 in the desired direction and the loading of the spring 1403, the arrangement is primed to have the involute move in the desired direction upon the occurrence of pressure in the combustion chamber as communicated to the involute 1301 by the secondary cylinder described above being lower than the spring 1403 coefficient. This movement of the involute 1501 relieves the tension on the spring 1403. The involute 1501 is prevented from rotating in the opposite direction by a click/lock 1502 mechanism mounted in the involute 1501 and engaging the ratchet 1302 on the base shaft 1301. The granularity of the teeth in the ratchet 1302 is of a preselected size. In the preferred embodiment, the granularity is small to allow the rotation of the involute 1501 to appear essentially continuous even though it is actually step wise.

Figure 16:
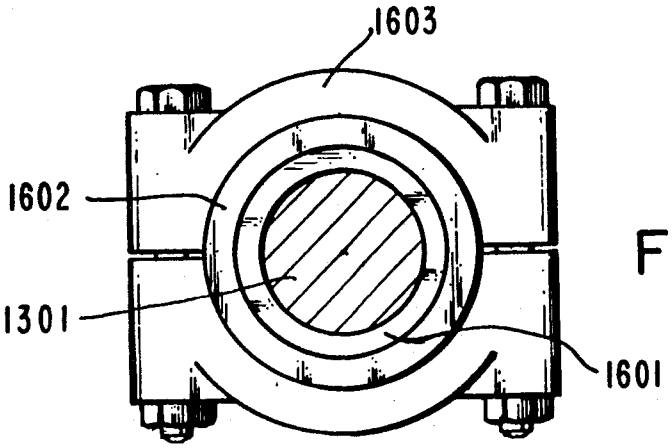
FIG. 16 illustrates a mount for the embodiment using a base shaft and sleeve; and, FIG. 17 illustrates the relationship of FIGS. 13 through 16.

As many individual involutes 1501 may be mounted along the arrangement, a "double" or two-stage bearing my be used in the middle for greater support. Such a bearing is depicted in FIG. 16. The bearing may be of the oil pressure type or a roller/ball bearing type. The bearing is comprised of a rotating inner bearing 1601 mounted within an outer bearing 1602 mounted on a journal 1603 which is positioned to support the arrangement. The inner bearing supports the base shaft 1301 while sections of the sleeve 1401 are attached to the outer bearing 1602.

Figure 17:
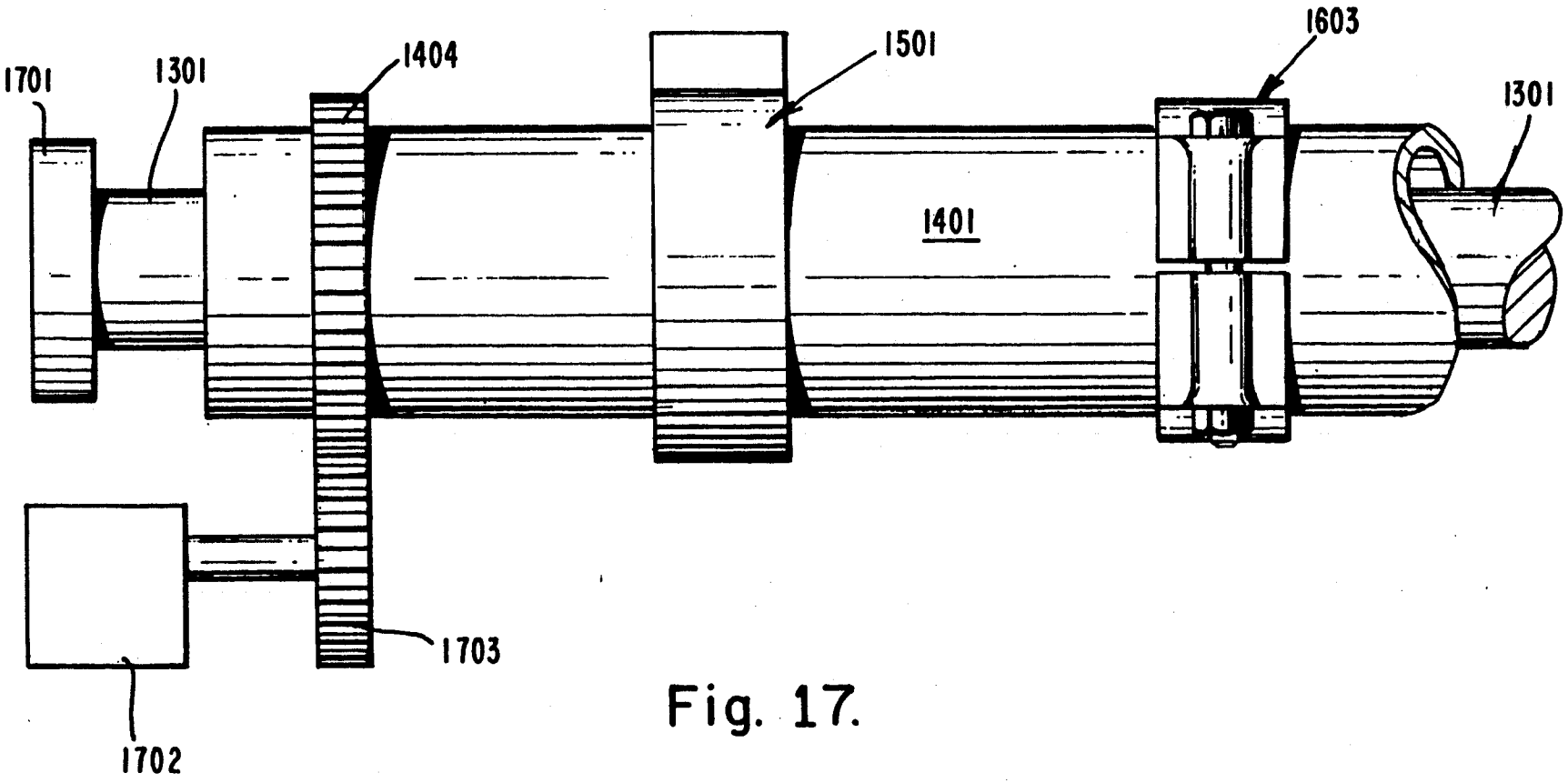

FIG. 17 shows the entire embodiment assembled into arrangement 17. A stepper motor 1702 is depicted as having a transmission gear 1703 engaging the drive gear 1404 of the sleeve 1401. The involute 1501 is rotated into the desired forward position under a controller connected to the stepper motor 1702. To reverse the position of the involute 1501, a clutch mechanism 1701 at one end of the base shaft 1301 is released which will cause the base shaft 1301 to rotate in the direction of lower compression. The use of the clutch 1701 on the end of the base shaft 1301 smoothes the above step wise motion of the shaft into a continuous function.

Since certain change may be made in the above apparatus without departing from the scope of the invention herein involved, it is intended that all matter contained in the above description, as shown in the accompanying drawing, shall be interpreted in an illustrative, and not a limiting sense.

What is claimed is:

1. An improved arrangement for a variable compression internal combustion engine having a plurality of primary cylinders in which a primary piston slides, driven by a crank shaft by means of a connecting rod, and a plurality of cylinder heads comprising in combination:

a plurality of secondary cylinders, one of which is mounted in said cylinder head in a position communicating with one of said primary cylinders to form a combustion chamber;

a secondary piston slidably mounted within each said secondary cylinders and having a first end forming a cap and a second end adjacent said primary piston forming a combustion chamber, the volume of which may be varied;

actuating means mounted on said cylinder head and reciprocating said secondary piston within said secondary cylinder comprising in combination;

a control means;

a rotational shaft positioned by said control means;

a plurality of involute surfaces mounted on said shaft, one of which is adjacent each said cap;

said cap of said secondary piston being formed as a wedge;

a key mounted in the side of said secondary piston;

walls forming a slot in said secondary cylinder engagable by said key whereby said secondary piston is aligned within said secondary cylinder so that the upper edge of said wedge is essentially normal to the surface of said involute; and, a return spring mounted between said secondary piston and said cylinder head whereby said cap is urged against said involute surface.

2. The arrangement defined in claim 1 further comprising:

a spark means mounted within said secondary piston and positioned to be in communication with said combustion chamber.

3. An improved arrangement for a variable compression internal combustion engine having a plurality of primary cylinders in which a primary piston slides, driven by a crank shaft by means of a connecting rod, and a plurality of cylinder heads comprising in combination:

a plurality of secondary cylinders, one of which is mounted mounted in said cylinder head in a position communicating with one of said primary cylinders to form a combustion chamber;

a secondary piston slidably mounted within each said secondary cylinders and having a first end forming a cap and a second end adjacent said primary piston forming a combustion chamber, the volume of which may be varied;

actuating means mounted on said cylinder head and reciprocating said secondary piston within said secondary cylinder comprising in combination;

a control means;

a rotational shaft positioned by said control means;

a plurality of worm gears mounted on said rotational shaft;

a plurality of threaded bolts mounted in said cylinder head and having a gear shaped head external to said cylinder head, at least one bolt adjacent each of said caps, said gear shaped head engagable with one of said worm gears;

a return spring mounted between said secondary piston and said cylinder head whereby said cap is urged against said bolt.

4. The arrangement defined in claim 3 wherein:

said control means comprises a servo motor actuator;

servo motor position sensor;

position limit switch whereby said servo motor actuator is disengaged under the condition of said said shaft being rotated to preselected limit positions;

intake manifold pressure sensor mounted in the intake manifold of the engine being controlled; and, a logic unit responsive to signals from said manifold pressure sensor and said servo motor position sensor whereby said servo motor actuator is activated to move said secondary piston to a preselected position within said secondary cylinder.

5. The arrangement defined in claim 4 further comprising:

a RPM sensor connected to said logic unit whereby said logic unit selects the position of said secondary piston based upon the additional information of the RPM of the engine being controlled.

6. The arrangement defined in claim 3 wherein:

said control means comprises a hydraulic drive actuator;

hydraulic drive position sensor;

position limit switch whereby said hydraulic drive actuator is disengaged under the condition of said said shaft being rotated to preselected limit positions;

intake manifold pressure sensor mounted in the intake manifold of the engine being controlled; and, a logic unit responsive to signals from said manifold pressure sensor and said hydraulic drive position sensor whereby said hydraulic drive actuator is activated to move said secondary piston to a preselected position within said secondary cylinder.

7. The arrangement defined in claim 6 further comprising:

a RPM sensor connected to said logic unit whereby said logic unit selects the position of said secondary piston based upon the additional information of the RPM of the engine being controlled.

8. An improved arrangement for a variable compression internal combustion engine having a plurality of primary cylinders in which a primary piston slides, driven by a crank shaft by means of a connecting rod, and a plurality of cylinder heads comprising in combination:

a plurality of secondary cylinders, one of which is mounted mounted in said cylinder head in a position communicating with one of said primary cylinders to form a combustion chamber;

a secondary piston slidably mounted within each said secondary cylinders and having a first end forming a cap and a second end adjacent said primary piston forming a combustion chamber, the volume of which may be varied;

a plurality of actuating means mounted on said cylinder head and reciprocating at least one of said secondary piston within said secondary cylinder each said actuating means comprising in combination;

a control means;

a rotational shaft positioned by said control means;

worm gear mounted on each said rotational shaft;

a control surface rotationally mounted on said cylinder head and having a gear shaped portion engagable with one of said worm gears and a portion adjacent said cap; and, a return spring mounted between said secondary piston and said cylinder head whereby said cap is urged against the end of said control surface.

9. The arrangement defined in claim 8 wherein:

said cap of said secondary piston is formed as a wedge;

a key mounted in the side of said secondary piston; and, walls forming a guide in said secondary cylinder engagable by said key whereby said secondary piston is aligned within said secondary cylinder so that the upper edge of said wedge is essentially normal to the surface of said involute.

10. The arrangement defined in claim 8 wherein:

said control means comprises a servo motor actuator;

servo motor position sensor;

position limit switch whereby said servo motor actuator is disengaged under the condition of said said shaft being rotated to preselected limit positions;

intake manifold pressure sensor mounted in the intake manifold of the engine being controlled; and, a logic unit responsive to signals from said manifold pressure sensor and said servo motor position sensor whereby said servo motor actuator is activated to move said secondary piston to a preselected position within said secondary cylinder.

11. The arrangement defined in claim 10 further comprising:

a RPM sensor connected to said logic unit whereby said logic unit selects the position of said secondary piston based upon the additional information of the RPM of the engine being controlled.

12. The arrangement defined in claim 8 wherein:

said control means comprises a hydraulic drive actuator;

hydraulic drive position sensor;

position limit switch whereby said hydraulic drive actuator is disengaged under the condition of said said shaft being rotated to preselected limit positions;

intake manifold pressure sensor mounted in the intake manifold of the engine being controlled; and, a logic unit responsive to signals from said manifold pressure sensor and said hydraulic drive position sensor whereby said hydraulic drive actuator is activated to move said secondary piston to a preselected position within said secondary cylinder.

13. The arrangement defined in claim 12 further comprising:

a RPM sensor connected to said logic unit whereby said logic unit selects the position of said secondary piston based upon the additional information of the RPM of the engine being controlled.

14. An improved arrangement for a variable compression internal combustion engine having a plurality of primary cylinders in which a primary piston slides, driven by a crank shaft by means of a connecting rod, and a plurality of cylinder heads comprising in combination:

a plurality of secondary cylinders, one of which is mounted mounted in said cylinder head in a position communicating with one of said primary cylinders to form a combustion chamber;

a secondary piston slidably mounted within each said secondary cylinders and having a first end forming a cap and a second end adjacent said primary piston forming a combustion chamber, the volume of which may be varied;

a plurality of actuating means, one of which is mounted on said cylinder head adjacent each said secondary piston and reciprocating said secondary piston within said secondary cylinder comprising in combination;

a control means;

a rotational shaft positioned by said control means;

a worm gears mounted on said rotational shaft;

a threaded bolt mounted in said cylinder head and having a gear shaped head external to said cylinder head adjacent each of said caps, said gear shaped head engagable with said worm gears;

a return spring mounted between said secondary piston and said cylinder head whereby said cap is urged against said bolt.

15. An improved arrangement for a variable compression internal combustion engine having a plurality of primary cylinders in which a primary piston slides, driven by a crank shaft by means of a connecting rod, and a plurality of cylinder heads comprising in combination:

a plurality of secondary cylinders, one of which is mounted in said cylinder head in a position communicating with one of said primary cylinders to form a combustion chamber;

a secondary piston slidably mounted within each said secondary cylinders and having a first end forming a cap and a second end adjacent said primary piston forming a combustion chamber, the volume of which may be varied;

actuating means mounted on said cylinder head and reciprocating said secondary piston within said secondary cylinder comprising in combination;

a control means;

a rotational base shaft having a plurality of ratchets having a preselected granularity formed along its outside surface, said base shaft being positioned by said control means;

a plurality of involute surfaces having a plurality of notches formed at a preselected radius, having a first wall formed at a second preselected radius and incorporating a click/lock mechanism mounted in said first wall, one of said involute surfaces mounted on each said ratchet of said base shaft, one said involute being adjacent each said cap;

a sleeve with a preselected inside diameter larger than said base shaft mounted over said base shaft;

a drive gear mounted on said sleeve and engaging the control means whereby said sleeve may be rotated under the direction of said control means;

a plurality of fingers formed in said sleeve and engagable with said notches;

a spring having a preselected coefficient mounted on at least one of said fingers between the sleeve and said involute notch whereby upon the rotation of said sleeve, said spring is loaded to rotate said involute in a preselected direction under the condition of the pressure in said combustion chamber being lower than said spring coefficient at least one step along said ratchet granularity, rotation of said involute in the opposite direction being prevented by said click/lock mechanism engaging said ratchet; and, a return spring mounted between said secondary piston and said cylinder head whereby said cap is urged against said involute surface forming a region of contact between said cap and said involute surface, said contact region being positioned to be on a line normal to the axis of said base shaft.

16. The arrangement defined in claim 15 further comprising:

a spark means mounted within said secondary piston and positioned to be in communication with said combustion chamber.

17. The arrangement defined in claim 15 wherein:

said control means comprises a servo motor actuator;

servo motor position sensor;

position limit switch whereby said servo motor actuator is disengaged under the condition of said shaft being rotated to preselected limit positions;

intake manifold pressure sensor mounted in the intake manifold of the engine being controlled; and, a logic unit responsive to signals from said manifold pressure sensor and said servo motor position sensor whereby said servo motor actuator is activated to move said secondary piston to a preselected position within said secondary cylinder.

18. The arrangement defined in claim 17 further comprising:

a RPM sensor connected to said logic unit whereby said logic unit selects the position of said secondary piston based upon the additional information of the RPM of the engine being controlled.

19. The arrangement defined in claim 15 wherein:

said control means comprises a hydraulic drive actuator;

hydraulic drive position sensor;

position limit switch whereby said hydraulic drive actuator is disengaged under the condition of said said shaft being rotated to preselected limit positions;

intake manifold pressure sensor mounted in the intake manifold of the engine being controlled; and, a logic unit responsive to signals from said manifold pressure sensor and said hydraulic drive position sensor whereby said hydraulic drive actuator is activated to move said secondary piston to a preselected position within said secondary cylinder.

20. The arrangement defined in claim 19 further comprising:

a RPM sensor connected to said logic unit whereby said logic unit selects the position of said secondary piston based upon the additional information of the RPM of the engine being controlled.

21. An improved arrangement for a variable compression internal combustion engine having a plurality of primary cylinders in which a primary piston slides, driven by a crank shaft by means of a connecting rod, and a plurality of cylinder heads comprising in combination:

a plurality of secondary cylinders, one of which is mounted in said cylinder head in a position communicating with one of said primary cylinders to form a combustion chamber;

a secondary piston slidably mounted within each said secondary cylinders and having a first end forming a cap and a second end adjacent said primary piston forming a combustion chamber, the volume of which may be varied;

actuating means mounted on said cylinder head and reciprocating said secondary piston within said secondary cylinder comprising in combination;

a control means;

a rotational base shaft having a plurality of ratchets having a preselected granularity formed along its outside surface, said base shaft being positioned by said control means;

a plurality of involute surfaces having a plurality of notches formed at a preselected radius, having a first wall formed at a second preselected radius and incorporating a click/lock mechanism mounted in said first wall, one of said involute surfaces mounted on each said ratchet of said base shaft, one said involute being adjacent each said cap;

a sleeve with a preselected inside diameter larger than said base shaft mounted over said base shaft;

a drive gear mounted on said sleeve and engaging the control means whereby said sleeve may be rotated under the direction of said control means;

a plurality of fingers formed in said sleeve and engagable with said notches;

a spring having a preselected coefficient mounted on at least one of said fingers between the sleeve and said involute notch whereby upon the rotation of said sleeve, said spring is loaded to rotate said involute in a preselected direction under the condition of the pressure in said combustion chamber being lower than said spring coefficient at least one step along said ratchet granularity, rotation of said involute in the opposite direction being prevented by said click/lock mechanism engaging said ratchet;

said cap of said secondary piston being formed as a wedge;

a key mounted in the side of said secondary piston;

walls forming a slot in said secondary cylinder engagable by said key whereby said secondary piston is aligned within said secondary cylinder so that the upper edge of said wedge is essentially normal to the surface of said involute; and, a return spring mounted between said secondary piston and said cylinder head whereby said cap is urged against said involute surface.

22. The arrangement defined in claim 21 further comprising:

a spark means mounted within said secondary piston and positioned to be in communication with said combustion chamber.

* * * * *